US005934675A

United States Patent [19]

Handelman et al.

[11] Patent Number: 5,934,675

[45] Date of Patent: Aug. 10, 1999

[54] LAS VEGAS SINGLE HAND 21 CARD GAME

[75] Inventors: Brian Handelman; Marc Handelman; Steve Kelley, all of Las Vegas, Nev.

[73] Assignee: Las Vegas Single Hand 21, LLC, Las Vegas, Nev.

[21] Appl. No.: 09/058,084

[22] Filed: Apr. 9, 1998

Related U.S. Application Data

[60] Provisional application No. 60/043,461, Apr. 10, 1997.

[51] Int. Cl.[6] ..... A63F 1/00

[52] U.S. Cl. ..... 273/292

[58] Field of Search ..... 273/292, 274, 273/309; 463/12, 13

[56] References Cited

U.S. PATENT DOCUMENTS 5,320,356 6/1994 Cauda ..... 273/292

OTHER PUBLICATIONS

"Top O' The Deck Blackjack" brochure, Sam's Town Las Vegas, 1995.

*Primary Examiner*—Benjamin H. Layno

*Attorney, Agent, or Firm*—John Edward Roethel

[57] ABSTRACT

The first two cards of the "Player's" hand are dealt face up as a community hand and placed at a community hand location. The dealer also deals two cards to himself comprising one card face up and one card face down and placed at a dealer's hand location. Then the first two cards forming the community hand automatically receive hits until the numerical count of the community hand is at least 12. Other numerical counts can be used such as 9, 10 or 11. Each player then individually chooses to "Hit" or "Stand" on the community hand. The dealer then plays his two cards and winners and losers are determined in the conventional manner. In an alternative variation, the initial deal comprises one card to the dealer and one "Community Card". Then each player gets one card for his hand and the dealer receives a card for the dealer's hand. The single "Community Card" is shared by both the dealer and each player giving the dealer and each player a two card hand. The first two cards forming each player's hand automatically receive hits until the numerical count of each player's hand is at least 12. Other numerical counts can be used such as 9, 10 or 11. Each player then individually chooses to "Hit" or "Stand" on the community hand. The dealer plays his two cards (the first dealer's card and the "Community Card") and winners and losers are determined in the conventional manner.

6 Claims, 3 Drawing Sheets

LAS VEGAS SINGLE HAND 21 CARD GAME

CROSS-REFERENCE TO RELATED APPLICATION

This application is based on and is a continuation-in-part of provisional application Ser. No. 60/043,461, filed Apr. 10, 1997, entitled Las Vegas Single Hand 21 Card Game.

BACKGROUND OF THE INVENTION

This invention relates to a card game, and more particularly to a card game based on the principles of Twenty-One but incorporating more hands per hour and more opportunities for the player to win.

Conventional Twenty-One has been a staple in the casino gaming business for many years. Conventional Twenty-One involves a game of chance between a dealer and one or more players. The object is for the player to achieve a numerical count of the cards in his hand closer to 21 than the numerical count of the cards in the hand of the dealer; but if the count of the player's hand goes over 21 then the player loses regardless of the final count of the dealer's hand.

The conventional manner of play of Twenty-One is as follows: A standard deck of fifty-two playing cards is used and each card counts its face value, except Aces which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially receives only one card which becomes the dealer's "up" card. After each player has stood on his first two cards or taken additional cards, the dealer then receives his second card.

A player may draw additional cards (take "hits") in order to try and beat the numerical count of the dealer's hand. If the player's numerical count exceeds 21, the player "busts." The player may "stand" on any numerical count of 21 or less. When a player busts, he loses his wager regardless of whether or not the dealer busts.

After all of the players have taken hits or have stood on their hand, the dealer "stands" or "hits" based on pre-established rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts (the numerical count of the cards in the dealer's hand exceeds 21), the player wins regardless of the numerical count of the cards in the player's hand. If neither the player nor the dealer has busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager not exceeding the amount of his initial ante. The dealer deals to the player one additional card and the resulting three card hand establishes the numerical count for the player's hand. The most widely used "Doubling Down" rules permit the player to "double down" only on 10 or 11 counts. Other variations allow players to "double down" on 9, 10 or 11; only on 11; or on any two cards regardless of the numerical count.

Another well-known procedure is "Splitting Pairs." If the player's first two cards are a pair, the player may "split" those cards into two separate hands. His original wager is applied to one of the hands and he makes an additional wager of the same amount as the first wager for the other hand. The player receives a new second card for each of the split hands. Each of the split hands is played separately and the player proceeds by standing or taking hits until he has achieved a hand count upon which he wishes to stand or until the player busts. However, if a player has split a pair of Aces, the player only receives one new card on each Ace; unless the new card is another Ace, in which case the player may again split the Aces and receive one new card on each Ace.

The player may "double down" on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a numerical count of 20 is a good hand to have, most experienced Twenty-One players are reluctant to risk such a hand by "splitting".

Another well-known procedure is "Insurance." If the dealer's up card is an Ace, the player may make an additional "insurance" bet. The insurance bets are made after each player receives his first two cards and the dealer reveals his up card and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a two-card 21 count, the player loses on his original ante but wins two-to-one odds on his second "insurance" bet. Also if the dealer has a two-card 21 count, that round of the game is over and all players lose except those who also have two-card 21 counts who tie or "push" with the dealer. If the dealer does not have a two-card 21 count, the player loses on his "insurance" bet and the round of the game continues.

As used in this disclosure and the accompanying claims, the terms "conventional Twenty-One" and "the conventional manner of play of Twenty-One" mean the game of Twenty-One as previously described and also including any of the known variations of the game of Twenty-One.

The game of Twenty-One has remained remarkably unchanged over the years. There have been a few other modifications proposed to the basic game, but none of these modifications have achieved universal popularity. For example, in the conventional manner of play of a Twenty-One game, the dealer shows one (the "up" card) of his first two cards and the other card (the "hole" card) is kept hidden until all the players have drawn to their hands. One modification involves the dealer showing both of his cards face-up before the players draw. This improves the player's odds of winning and the payout odds have been modified to adjust for this change so that the house's advantage remains.

However, conventional Twenty-One has become predictable and plays at a fairly regular pace in most casinos. The revenue generated in most casinos by conventional Twenty-One is not capable of being increased significantly without increasing the minimum wager required to be made by the player. However, many casino patrons desire to play low stakes Twenty-One in which each wager need not exceed $2, $3 or even $5 per hand.

In order to increase casino revenue for a game such as Twenty-One without making the minimum wager so high as to discourage the average casino patron, it is necessary to increase the number of hands per hour of Twenty-One that can be dealt at the Twenty-One table.

There is also a need to increase the fun and excitement of playing Twenty-One so that players will be encouraged to continue to play the game. It is desirable to create a group atmosphere at the Twenty-One table so that the players can root for each other while attempting to beat the dealer. This can be accomplished by the use of community cards that are common to each player's hand thereby giving all of the players a common interest in the success or failure of the community cards.

It is an object of the present invention to provide a game of chance based on the principles of Twenty-One in which the casino revenues may be increased by increasing the number of hands per hour that can be dealt at the Twenty-One table.

It is a further object of the present invention to create a common group interest in the outcome of each round of play so as to create a group atmosphere at the gaming table and thereby increase the enjoyability of playing the game.

It is a feature of the present invention to deal the first two cards of the "Player's" hand as a community hand that is played by all players. The first two cards forming this community hand automatically receive hits until the numerical count of the community hand is at least 12. Other numerical counts can be used such as 9, 10 or 11, but a numerical count of at least 12 is the most preferred numerical count at which the automatic hitting of the community hand stops. Each player then individually chooses to "Hit" or "Stand" on the community hand. The dealer plays his two cards in the conventional manner and winners and losers are determined in the conventional manner.

It is a further feature of an alternative variation of the present invention to initially deal one card to the dealer and one "Community Card". Then each player gets one card for his hand. The single "Community Card" is shared by both the dealer and each player. This "Community Card" along with the other card dealt to each of the dealer and the players gives the dealer and each player a two card hand. The first two cards forming each player's hand automatically receive hits until the numerical count of each player's hand is at least 12. Other numerical counts can be used such as 9, 10 or 11, but a numerical count of at least 12 is the most preferred numerical count at which the automatic hitting of the community hand stops. Each player then individually chooses to "Hit" or "Stand" on his resulting hand. The dealer plays his two cards (the first dealer's card and the "Community Card") in the conventional manner and winners and losers are determined in the conventional manner.

It is an advantage of the present invention that a new and creative game based on the principles of Twenty-One is provided that speeds up the play of the game increasing both the revenues to the casino and the opportunity for the players to win larger amounts than would be possible under the slower conventional manner of play of Twenty-One.

It is a further advantage of the present invention that a common rooting interest for the players is created by the use of community cards whereby all of the players together share in the winning atmosphere or commiserate when a losing hand occurs.

Other objects, features and advantages of the present invention will become apparent from a consideration of the following detailed description.

SUMMARY OF THE INVENTION

The method of the present invention comprises dealing the first two cards of the "Player's" hand as a community hand that is played by all players. The first two cards are dealt face up and placed at a community hand location on the table layout. The dealer also deals two cards to himself comprising one card face up and one card face down and placed at a dealer's hand location on the table layout.

At this point, each player (using the community hand) has the option individually to engage in the customary Twenty-One game activities such as "Splitting Pairs", "Doubling Down" and "Taking Insurance" as those instances arise based on the two cards forming the community hand.

Then the first two cards forming the community hand automatically receive hits until the numerical count of the community hand is at least 12. numerical counts can be used such as 9, 10 or 11, but a numerical count of at least 12 is the most preferred numerical count at which the automatic hitting of the community hand stops. Each player then individually chooses to "Hit" or "Stand" on the community hand. The dealer then plays his two cards in the conventional manner and winners and losers are determined in the conventional manner.

In an alternative variation of the present invention, the initial deal comprises one card to the dealer and one "Community Card". Then each player gets one card for his hand and the dealer receives a card for the dealer's hand. The single "Community Card" is shared by both the dealer and each player giving the dealer and each player a two card hand. The first two cards forming each player's hand automatically receive hits until the numerical count of each player's hand is at least 12. Other numerical counts can be used such as 9, 10 or 11, but a numerical count of at least 12 is the most preferred numerical count at which the automatic hitting of the community hand stops. Each player then individually chooses to "Hit" or "Stand" on the community hand. The dealer plays his two cards (the first dealer's card and the "Community Card") in the conventional manner and winners and losers are determined in the conventional manner.

DETAILED DESCRIPTION OF THE PREFERRED EMBODIMENTS

Figure 1:
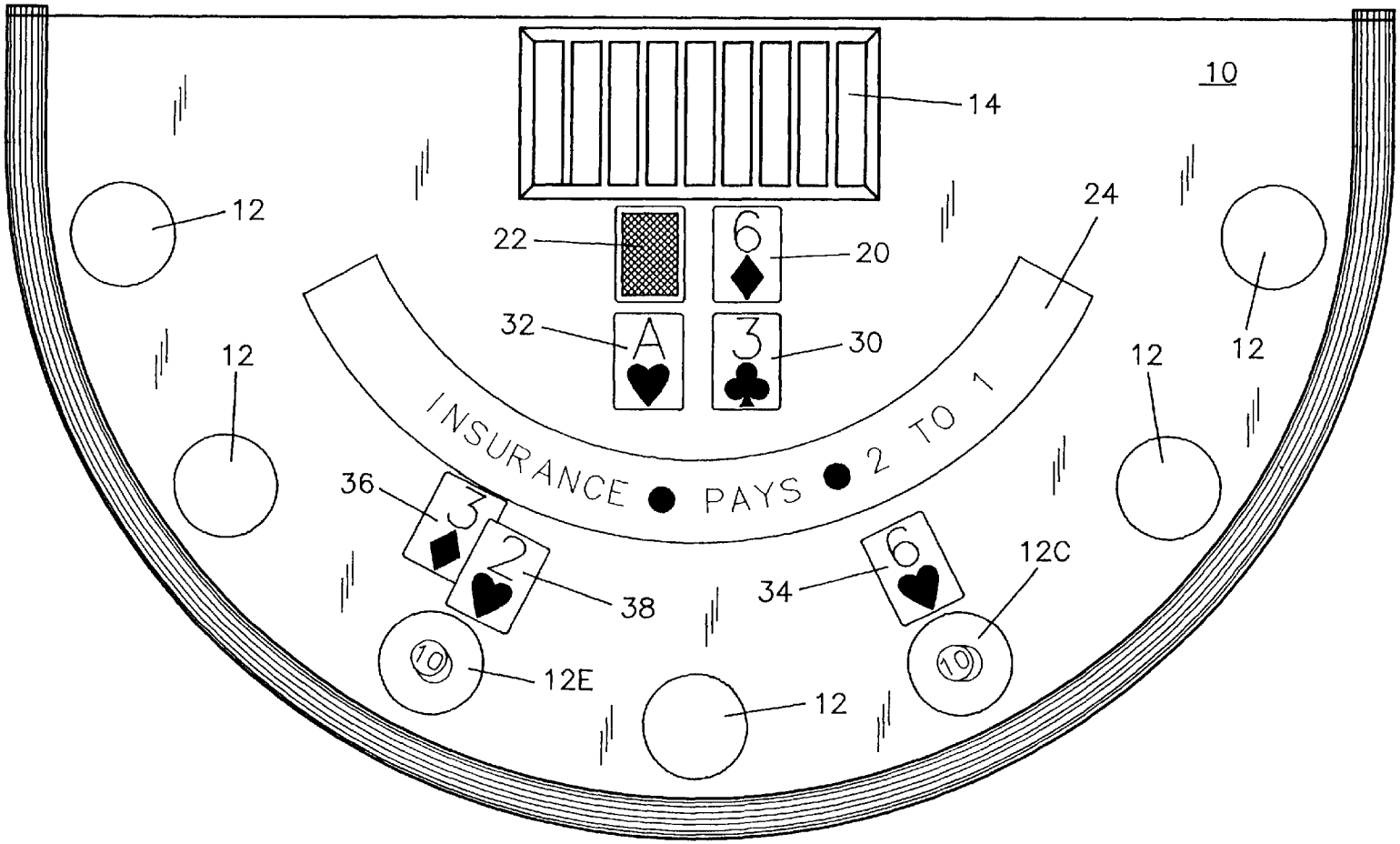
FIG. 1 shows a schematic representation of a table layout used in the method of play of the present invention with a representative deal of the cards displayed.

FIG. 1 shows the gaming table layout 10 that is used in the practice of the method of the present invention. One or more players sit around the semicircular portion of the gaming table layout. Locations 12 (such as betting circles) are provided for each player to make his wagers to participate in the play of the game. The dealer stands along the straight portion of the table layout adjacent the chip rack 14. The dealer initially deals two community cards 30 and 32 and two dealer's cards 20 and 22 to commence the play of the game. The two community cards 30 and 32 can be placed in any suitable location on the table layout, such as just above an information box 24 on the table layout 10. Each of the initial two community cards 30 and 32 are dealt face up so that all players may see the values of these cards.

The two dealer's cards 20 and 22 are placed at any suitable location on the table layout so as to be designated as the dealer's cards, most preferably immediately in front of the chip rack 14 as is conventional. The dealer's cards are dealt one card face up 20 and one card face down 22.

After the initial deal of the two community cards 30 and 32 and the two dealer's cards 20 and 22, each player (using the community hand) has the option individually to engage in the customary Twenty-One game activities such as "Splitting Pairs", "Doubling Down" and "Taking Insurance" as those instances arise based on the two cards forming the initial community hand.

In the preferred method of play of the present invention, any two cards comprising a pair may be split into two separate hands. In the event a pair is split, the player must make an additional wager equal to his original wager to cover the second hand. All "Splitting Pairs" activity is conducted according to the conventional rules of splitting pairs according to the conventional manner of play of Twenty-One.

Since each player is playing the community hand, each player has the option of whether to split pairs or not. For those players who elect not to split a pair, the method of play continues in the same manner as would conventional Twenty-One had the player elected not split a pair.

In the preferred method of play of the present invention, "Doubling Down" is available whenever the first two cards in the community hand have a numerical total of 9, 10 or 11. Again, each player individually may elect to "Double Down" or not. If a player elects to "Double Down", the conventional manner of proceeding with a "Double Down" wager and the subsequent play of the hand is applied to that player's wagers. If a player chooses not to "Double Down", then the play continues in the same manner as would conventional Twenty-One had the player chose not to "Double Down".

Likewise, "Insurance" wagers are conducted in the same manner as would occur in the conventional manner of play of Twenty-One. Again, each player individually has the option to take "Insurance" in those instances that "Insurance" is an option.

After all potential wagering opportunities are exhausted based on the numerical value of the initial two community cards and the dealer's first two cards, then the first two cards forming the community hand automatically receive hits from the dealer until the numerical count of the community hand is at least 12. Other numerical counts can be used such as 9, 10 or 11, but a numerical count of at least 12 is the most preferred numerical count at which the automatic hitting of the community hand stops. In other words, the gaming establishment which is conducting the game selects one of the numerical counts of either 9, 10, 11 or 12 as the numerical count at which the automatic hitting of the community hand will stop when the numerical count of the community hand reaches at least the preselected number. However, the most preferred numerical count to be used is 12.

Any additional community cards dealt are placed at a suitable location on the table layout, preferably adjacent to the original two community cards. At this point, no more cards are dealt as community cards.

For example, as shown in FIG. 1, the first two community card 30 and 32 have a numerical count of 14 since the Ace is always counted as an eleven count card for this purpose. Since the first two community cards have a numerical count of at least 12, no more community cards are dealt.

Each player then individually chooses to "Hit" or "Stand" on the numerical count of the cards forming the community hand. The dealer proceeds around the table layout in order beginning from the dealer's left as is conventional. Each player either takes one or more hits or stands in the manner of play of conventional Twenty-One. Any cards dealt to a particular player are placed on the table layout in a suitable location, preferably adjacent the player's wagering location thereby designating those cards are belonging only to that player.

Again for example, as shown in FIG. 1, the player sitting a location 12C takes a hit and receives a Six of Hearts 34. This card combined with the two community cards gives the player at location 12C a numerical count of 20 and the player would most likely stand on that count.

The player at location 12E also takes a hit and receives first a Three of Diamonds 36. This gives the player at location 12E a numerical count of 17 or 7, depending on whether the Ace is counted as eleven or one. Since a numerical count of 17 is a marginal hand in Twenty-One, the player at location 12E elects to take another hit and he receives a Two of Hearts 38. Now this player has a numerical count of 19 (or 9) and since a numerical count of 19 is a much better hand in Twenty-One, this player elects to stand at this point.

After all players have completed hitting and/or standing, the dealer then plays his two cards in the conventional manner. In the preferred method of play of the present invention, the dealer will stand on all numerical counts of 18 or higher, will stand on numerical counts of hard 17 and will hit on numerical counts of soft 17.

Winners and losers are determined in the conventional manner. Winning hands are paid at even money, except that Blackjacks are paid at 3-to-2, as is conventional.

Figure 2:
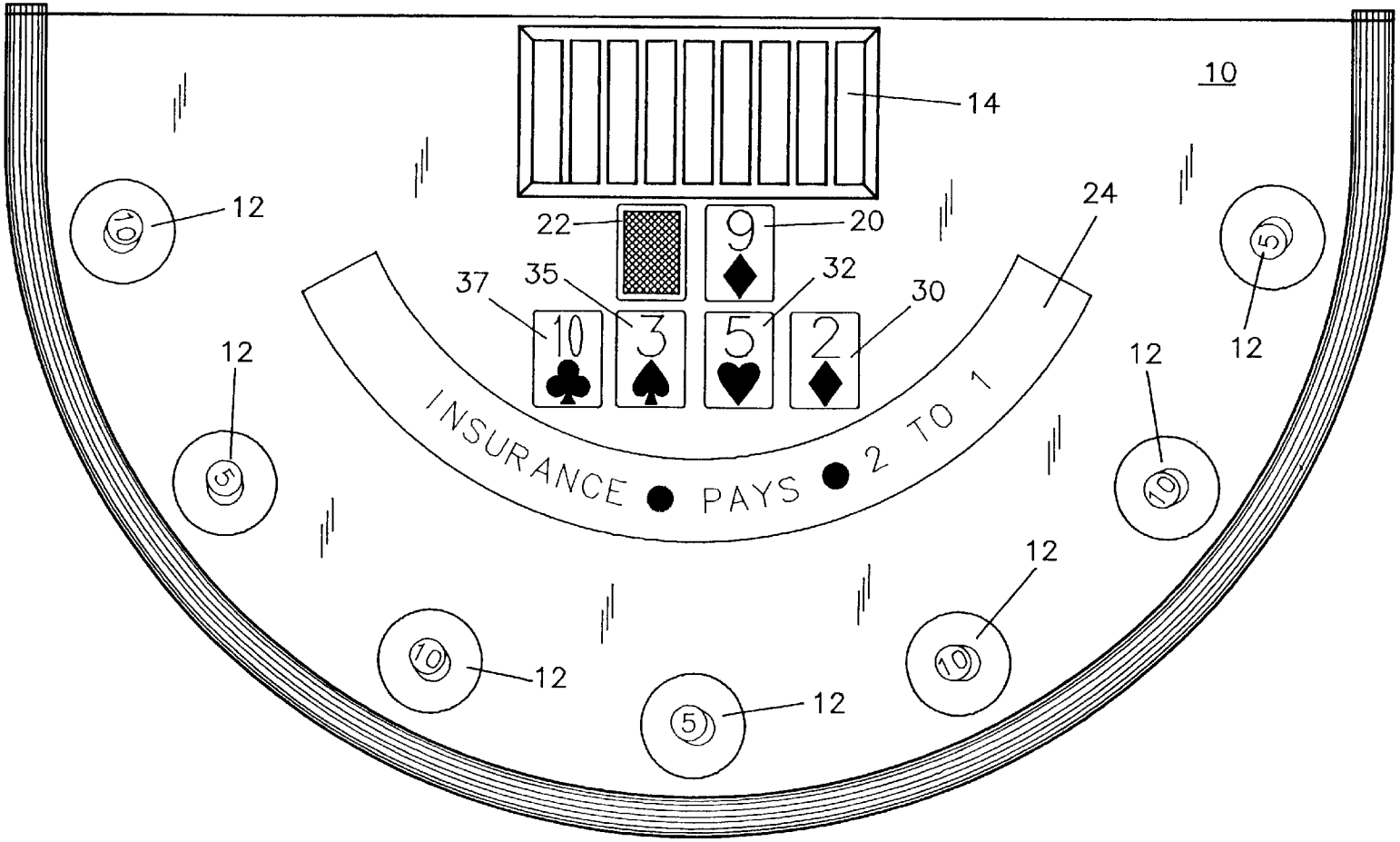
FIG. 2 shows a schematic representation of a table layout used in the method of play of the present invention with a different representative deal of the cards displayed.

FIG. 2 shows another representative example of the method of play of a round of the present invention. In this example, the first two community cards dealt are a Two of Diamonds 30 and a Five of Hearts 32. These two community cards do not offer a "Splitting Pair", "Double Down" or "Insurance" opportunity, so the play continues. The numerical count of these first two cards is 7 (which is less than 12), so an additional card is dealt as a community card. The third community card dealt is a Three of Hearts 35 creating a numerical count of 10 for the community cards. Since this numerical count is still less than 12, still another community card is dealt. The fourth community card dealt is a Ten of Clubs. Now the community hand has numerical count of 20 (which is more than 12) and no further community cards are dealt.

Each player would stand on a numerical count of 20, so no players take additional hits. The dealer then reveals his face down card 22, stand or hits according to conventional manner of play of Twenty-One and pays players with winning hands and collects from players with losing hands.

In this example, a community rooting interest is created since all players are playing the same numerical count and will either win together or lose together (or push together) depending solely on the outcome of the dealer's hand.

Figure 3:
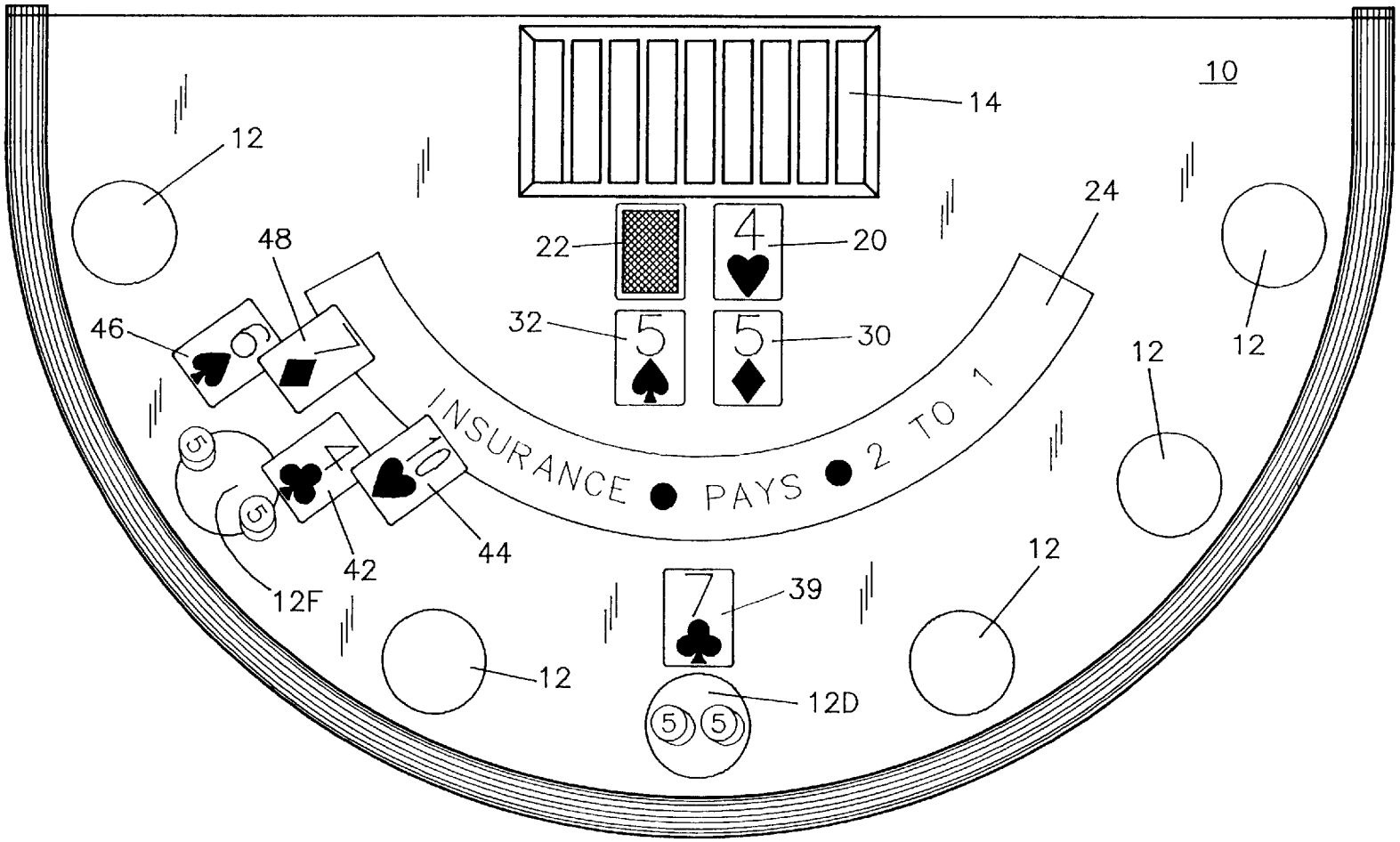
FIG. 3 shows a schematic representation of a table layout used in the method of play of the present invention with a third representative deal of the cards displayed.

FIG. 3 shows another representative example of the method of play of a round of the present invention. In this example, the first two community cards dealt are a Five of Diamonds 30 and a Five of Spades 32. In this example, a modification of the community card hitting rule comes into play. In this modification, the dealer will never deal additional community cards to a hand that has a Splittable Pair. A "Splittable Pair" is a hand of two like pip cards from Ace's up through Tens (excluding Jacks, Queens and Kings). Since the first two community cards in the example shown in FIG. 3 comprise a Splittable Pair, no additional community cards are dealt and each player must then decide individually how to play his hand.

In this example, the player at location 12D has decided to "Double Down" since the numerical count of the first two community cards is 10. The Double Down procedure follows in the conventional manner of Double Down play in Twenty-One. The player makes a second wager not exceeding the amount of his first wager and receives one card, the Seven of Clubs 39. Thus, the player at location 12D has a final numerical count of 17.

The player at location 12F has decided to "Split Pairs" and proceeds in the conventional manner for Splitting Pairs play in Twenty-One. The player makes a second wager equal to the amount of his first wager and each Five becomes the first card of two separate hands for the player. On the player's first hand, the player receives a Four of Clubs 42, takes another hit and receives the Ten of Hearts 44 and stands with a numerical count of 19. On the player's second hand, the player receives a Six of Spades 46, takes another hit and receives the Seven of Diamonds 48 and stands with a numerical count of 18.

After all players have completed hitting and/or standing, the dealer then reveals his face down card 22, stands or hits according to conventional manner of play of Twenty-One and pays players with winning hands and collects from players with losing hands.

The method of play of the present invention can be modified by the addition of a side bet to the play of the game. Each player has the option of making an additional wager at the beginning of each round of the game that the two community cards will be a Blackjack (an Ace and a 10 count card). Any suitable odds can be paid on this side bet wager, such as 20-to-1 odds based on the amount of the side bet wager.

An alternative version of the present invention involves having a single community card shared among the dealer and the players.

After the shuffle of the deck of cards, one card is dealt face up to the dealer and one community card is dealt face up and placed at an appropriate location on the table layout. Then each player gets one card for his hand dealt face up. The single community card is shared by both the dealer and each player giving the dealer and each player a two card hand.

Each player's hand (the community card and the first player card) automatically receive additional cards until the numerical count of each player's hand is at least 12. Other numerical counts can be used such as 9, 10 or 11, but a numerical count of at least 12 is the most preferred numerical count at which the automatic hitting of the community hand stops. Each player then individually chooses to "Hit" or "Stand" on his particular hand. The dealer plays his two cards (the first dealer's card and the community card) in the conventional manner of play of Twenty-one and winners and losers are determined in the conventional manner.

If the first two cards of a player's hand (the community card and the first player card) are cards that the player could "Double Down" or "Split Pairs" on, then the dealer allows the player the opportunity to engage in such an option before the dealer conducts any automatic hits on that player's hand. Likewise, each player is given the opportunity to make an "Insurance" wager in those situations that an insurance wager would be applicable.

After each player plays out his hand, the dealer then plays out the dealer's hand (the community card and the dealer's first card) according to the conventional manner of play for completing the dealer's hand. Winning and losing hands are then determined in the conventional manner.

This variation of the present invention creates a group atmosphere among the players since each player shares a common card with the other players at the gaming table. This variation also allows each player to be more heads up with the dealer because each player also shares a common card with the dealer. Finally, this variation speeds up the play of the game thereby increasing the number of hands per hour that can be dealt at the gaming table and therefore increasing the revenues generated to the gaming establishment.

While the invention has been illustrated with respect to several specific embodiments thereof, these embodiments should be considered as illustrative rather than limiting. Various modifications and additions may be made and will be apparent to those skilled in the art.

What is claimed is:

1. A method of playing a card game based on the conventional manner of play of Twenty-One in which Aces have a numerical value of one or eleven, face cards have a numerical of ten and each other card has a numerical value of its pips comprising:

a) dealing two cards and displaying both cards face up as community cards;

b) dealing two cards comprising a dealer's hand and displaying one card face up;

c) if the two community cards total a numerical value of at least twelve when Aces are always counted as having a numerical value of eleven, dealing no more community cards;

d) if the two community cards have a total numerical value of eleven or less when Aces are always counted as having a numerical value of eleven, dealing additional cards as community cards until the total numerical value of the community cards is at least twelve when Aces are always counted as having a numerical value of eleven;

e) a player, including the numerical count of all of the community cards in the player's hand, either standing or hitting to receive one or more additional cards according to the conventional manner of play of Twenty-One;

f) the dealer exposing his second card and standing or hitting to receive one or more additional cards in the dealer's hand according to the conventional manner of play of Twenty-One;

g) determining the winning hand between the dealer's hand and the player's hand according to the conventional manner of play of Twenty-One.

2. The method of claim 1 in which the player makes a wager to participate in the game and the dealer paying the player a winning amount if the player's hand wins and the dealer collecting the amount of the player's wager if the dealer's hand wins.

3. The method of claim 2 further including the player making a second wager to be eligible for a special payout in the event the dealer's first two cards are a Blackjack.

4. A method of playing a card game based on the conventional manner of play of Twenty-One in which Aces have a numerical value of one or eleven, face cards have a numerical of ten and each other card has a numerical value of its pips comprising:

a) dealing two cards and displaying both cards face up as community cards;

b) dealing a card for a dealer's hand and displaying the card face up;

c) if the two community cards total a numerical value of at least twelve when Aces are always counted as having a numerical value of eleven, dealing no more community cards;

d) if the two community cards have a total numerical value of eleven or less when Aces are always counted as having a numerical value of eleven, dealing additional cards as community cards until the total numerical value of the community cards is at least twelve when Aces are always counted as having a numerical value of eleven;

e) a player, including the numerical count of all of the community cards in the player's hand, either standing or hitting to receive one or more additional cards according to the conventional manner of play of Twenty-One;

f) dealing to the dealer's hand a second card face up;

g) the dealer standing or hitting to receive one or more additional cards in the dealer's hand according to the conventional manner of play of Twenty-One;

h) determining the winning hand between the dealer's hand and the player's hand according to the conventional manner of play of Twenty-One.

5. The method of claim 4 in which the player makes a wager to participate in the game and the dealer paying the player a winning amount if the player's hand wins and the dealer collecting the amount of the player's wager if the dealer's hand wins.

6. The method of claim 5 further including the player making a second wager to be eligible for a special payout in the event the dealer's first two cards are a Blackjack.

* * * * *